US005503385A

United States Patent [19]

Tsushima et al.

[11] Patent Number: 5,503,385

[45] Date of Patent: Apr. 2, 1996

[54] PAPER FEEDING CASSETTE

[75] Inventors: Mitsuo Tsushima, Morioka; Toshiaki Amano, Yamagishi, both of Japan

[73] Assignee: Alps Electric Co., Ltd., Tokyo, Japan

[21] Appl. No.: 300,508

[22] Filed: Sep. 2, 1994

[30] Foreign Application Priority Data

Sep. 7, 1993 [JP] Japan ..... 5-246291

[51] Int. Cl.[6] ..... B65H 3/54

[52] U.S. Cl. ..... 271/170; 271/171

[58] Field of Search ..... 271/170, 171, 271/169, 162

[56] References Cited

U.S. PATENT DOCUMENTS

| | | | |
|---|---|---|---|
| 3,738,646 | 6/1973 | Samczyk | 271/170 |
| 4,032,136 | 6/1977 | Komaba et al. | 271/170 X |
| 4,363,477 | 12/1982 | Miyashita | 271/170 X |
| 5,145,164 | 9/1992 | Kan | 271/170 |
| 5,183,248 | 2/1993 | Okada et al. | 271/127 |

FOREIGN PATENT DOCUMENTS

| | | | |
|---|---|---|---|
| 6171769 | 6/1994 | Japan | 271/170 |

*Primary Examiner*—David H. Bollinger

*Attorney, Agent, or Firm*—Guy W. Shoup; Patrick T. Bever

[57] ABSTRACT

The present invention has its object to achieve a reduction in the size and cost of a paper feeding cassette. A cassette body (2) which can contain a plurality of papers is provided with a pair of front-edge guide sections (3) and (3) for positioning the front-edges of the papers, a pair of traverse guide sections (4) and (4) for positioning the side-edges of the papers, a rear-edge guide section (5) for positioning the rear-edges of the papers, a pair of separating sections (6) and (6) for separating one at a time the papers contained in the cassette body (2), and a pair of push-up members (7) and (7) for pushing upward both side sections of the front-edges of the papers toward the lower surfaces of a pair of separating sections (6) and (6). Both side sections of the front-edges of the papers are pushed upward toward the lower surfaces of the separating sections (6) and (6) by the elasticity of the push-up members (7) and (7).

7 Claims, 6 Drawing Sheets

WHEN B5-SIZE PAPERS ARE USED

PAPER FEEDING CASSETTE

BACKGROUND OF THE INVENTION

1. Field of the Invention

The present invention relates to a paper feeding cassette used for a printer, a copying machine or the like, and more particularly, to a paper feeding cassette having a simple construction which is capable of feeding various sizes of papers with a single cassette.

2. Description of the Related Art

Conventionally, various kinds of different-sized papers, such as A3-size, A4-size, B5-size, letter-size and legal-size have been used in a printer or a copying machine. These papers are contained in a paper feeding cassette and at the time of printing or copying (hereinafter jointly referred to as image production apparatus) they are separated one at a time to be automatically fed into the apparatus, such as the printer or the copying machine, from the paper feeding cassette.

FIGS. 6 and 7 show the construction of the conventional paper feeding cassette. In a cassette body b which constitutes a paper feeding cassette a, a rear-edge positioning plate c for controlling the rear-edge position of papers P . . . and a movable side plate d for controlling the position of the side-edge surfaces of the papers P . . . are provided. At a forward portion of the cassette body b, a press-contact plate e is provided. The press-contact plate e is pressed upward by a pair of springs f and a pair of auxiliary springs g to press elastically the uppermost paper P against feed rollers h provided at the printer, copying machine or the like.

Recently, with the reduction in the size of apparatuses such as a printer and a copying machine or the like, a demand for substantially reducing the thickness of the paper feeding cassette to be mounted on the apparatus has increased. In addition, a demand for reducing the cost of the paper feeding cassette has also increased.

However, since the conventional paper feeding cassette includes numerous parts as described above, the press-contact plate e and the mechanisms for pushing upward the press-contact plate e, it is difficult to reduce the size thereof by reducing its thickness, and it is also difficult to reduce the cost thereof.

SUMMARY OF THE INVENTION

It is an object of the present invention to provide a paper feeding cassette capable of achieving a reduction in the size and cost thereof while efficiently maintaining its function of separating and feeding a plurality of papers contained therein one at a time.

It is another object of the present invention to provide a paper feeding cassette including a pair of separating sections for separating and feeding a plurality of papers contained in a cassette body one at a time, in which a pair of push-up members for pushing upward the papers toward the lower surfaces of a pair of separating sections are mounted on the cassette body so that the papers are pushed upward toward the lower surfaces of a pair of separating sections by the elasticity of the push-up members.

It is still another object of the present invention to provide a paper feeding cassette in which a pair of separating sections are formed integrally with the cassette body.

It is a further object of the present invention to provide a paper feeding cassette in which the cassette body is capable of containing different-sized first and second size papers, and is provided with a pair of separating sections and a pair of push-up members in accordance with the first and second size papers, respectively.

It is still further object of the present invention to provide a paper feeding cassette including a pair of separating sections for separating and feeding a plurality of papers contained in a cassette body one at a time in which traverse guide members for guiding side-edges of the papers to be contained in the cassette body are provided movably in the width direction of the papers, and the traverse guide members are provided with a pair of separating sections and a pair of push-up members for pushing the papers upward toward the lower surfaces of a pair of separating sections so that the papers are pushed upward toward lower surfaces of the separating sections by the elasticity of the push-up members.

According to a paper feeding cassette of the present invention, both side sections of the front-edges of the papers contained in the cassette body are pushed upward by a pair of push-up members to be pressed to the lower surfaces of a pair of separating sections. In this state, paper feeding rollers mounted on the printer is pushed downward from above the cassette body to be brought into contact with the upper surface of the papers. With a rotation of the rollers, the papers are separated by a pair of separating sections and a pair of push-up members one at a time to be fed.

And, according to a paper feeding cassette of the present invention, a pair of separating sections are formed integrally with a cassette body. Thus, parts count of the paper feeding cassette maybe reduced.

Further, according to a paper feeding cassette of the present invention, several kinds of different-sized papers may be contained, and a pair of separating sections and a pair of push-up members are provided in accordance with the size of the contained papers. Thus, several kinds of the papers may be treated with a single cassette.

Still further, according to a paper feeding cassette of the present invention, side-edge guide members for guiding side-edges of the papers are provided movably in the width direction of the papers, and these side-edge guide members are provided with a pair of separating sections and a pair of push-up members. Thus, several kinds of the papers may be treated with a single cassette.

DESCRIPTION OF THE PREFERRED EMBODIMENTS

Figure 1:
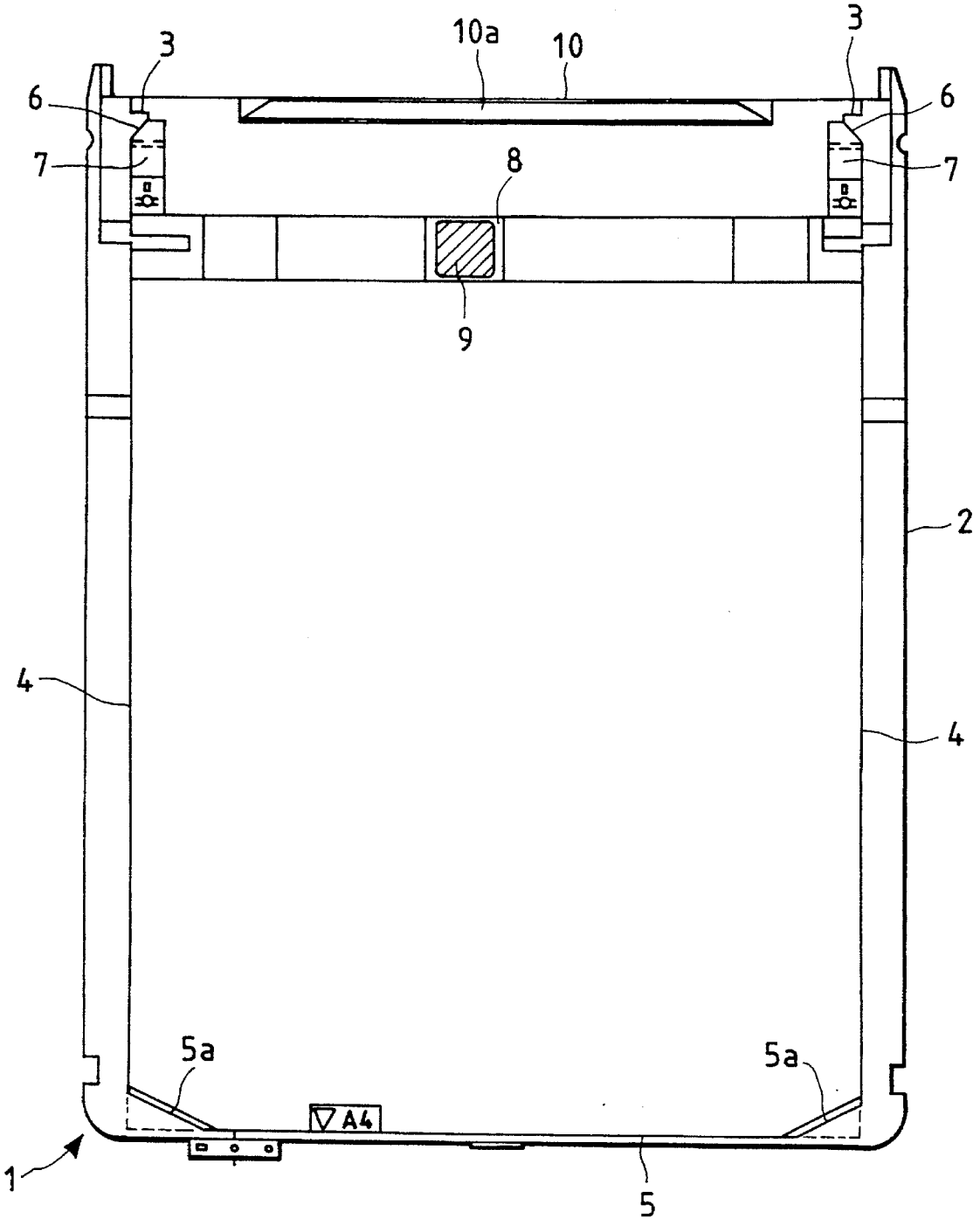
FIG. 1 is a plan view showing a paper feeding cassette according to a first embodiment of the present invention.
Figure 2:
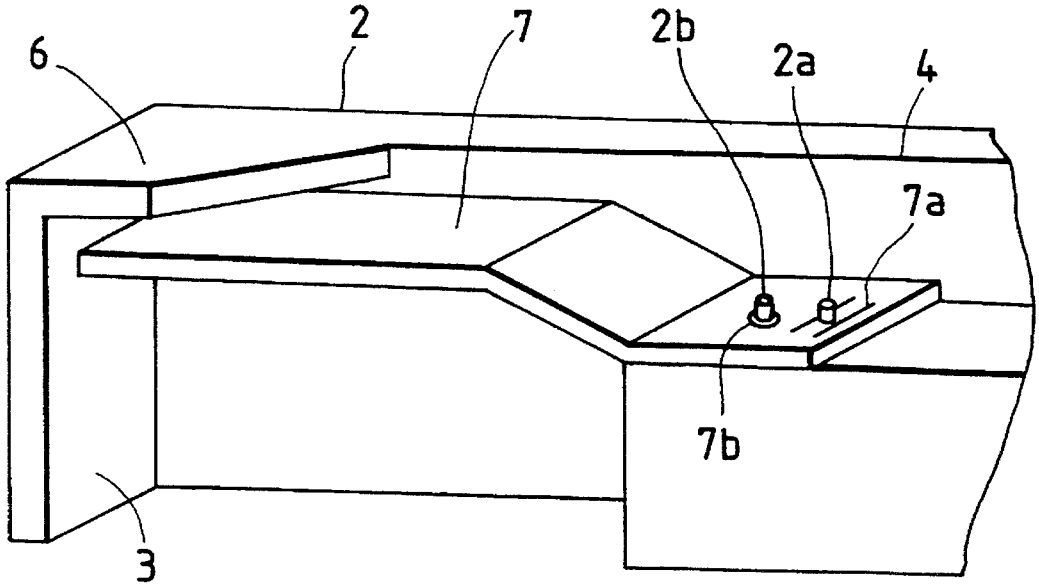
FIG. 2 is a main part perspective view showing construction of the separating sections and push-up members shown in FIG. 1.

The preferred embodiments of the paper feeding cassette according to the present invention will be described with reference to FIGS. 1 to 5. FIGS. 1 and 2 show a first embodiment of the present invention. FIG. 1 is a plan view of a paper feeding cassette and of the present invention, and FIG. 2 is a main part perspective view of a separating section of a paper feeding cassette of the present invention. The cassette 2 can contain about 30 sheets of A4-size papers and is provided with a pair of front-edge guide sections 3 and 3 for positioning the front-edges of the contained papers, a pair of side-edge guide sections 4 and 4 for positioning the side-edges of the papers, a rear-edge guide section 5 for positioning rear-edges of the papers, and a pair of separating sections 6 and 6 for separating and forwarding one at a time the papers (not shown) contained in the cassette.

At both sides of the rear-edge guide section 5, a pair of guide grooves 5*a* and 5*a* are provided for guiding the upper surface of both side sections of the rear-edges of the papers when both side sections of the rear-edges of the papers are inserted therein. Further, the cassette 2 is provided with a pair of plate spring-like push-up members 7 and 7 for pushing upward both side sections of the front-edges of the papers (not shown) contained therein toward the lower surfaces of a pair of separating sections 6 and 6. The papers are pushed upward by the elasticity of a pair of pushing-up members 7 and 7, thereby bringing the upper surface of the both side sections of the front-edge of the uppermost paper into contact with the lower surfaces of a pair of separating sections 6 and 6.

At the bottom of the cassette body 2, a recessed portion 8 is formed. A square friction member 9 is affixed to the recessed portion 8 to prevent several sheets of the papers contained in the cassette from being separated and forwarded at one time. The friction member 9 is affixed in such a state that the upper surface thereof is flushed with the upper surface of the bottom of the cassette. Further, a paper guide section 10 is formed at the front-edge portion of the cassette 2 for guiding the separated paper upward. An inclined surface 10*a* is formed on the paper guide section 10 for guiding the papers diagonally upward.

FIG. 2 is a main part perspective view showing construction of the separating section 6 and the push-up member 7 of the paper feeding cassette 1 of FIG. 1. It shows the front-edge guide section 3, the separating section 6 and the push-up member 7. As shown in the drawing, bosses 2*a* and 2*b* are provided on the cassette body 2, and an H-shaped cut section 7*a* and a hole 7*b* are formed in one end portion of the plate spring-like push-up member 7.

The H-shaped cut section 7*a* is press-fitted to the boss 2*a* of the cassette body 2, and boss 2*b* is fitted into the hole 7*b* formed in the push-up member 7.

The other end portion of the push-up member 7 is arranged at such a position that it pushes upward both side sections of the front-edges of the papers contained in the cassette body 2 toward the lower surface of the separating section 6, thereby bringing the upper surface of both side sections of the front-edge of the uppermost paper into contact with the lower surface of the separating section 6.

The paper feeding cassette of this embodiment functions as follows.

A pair of front-edge guide sections 3 and 3, a pair of side-edge guide sections 4 and 4, and the rear-edge guide section 5 position, respectively, the front-edges, the side-edges and the rear-edges of the papers (not shown) contained in the cassette body 2. Both side sections of the front-edges of the papers contained in the cassette body 2 are pushed upward toward the lower surfaces of a pair of separating sections 6 and 6 by the elasticity of a pair of push-up members 7 mounted on the cassette body 2, thereby bringing the upper surface of the uppermost paper into contact with the lower surfaces of a pair of separating sections 6.

In this state, a paper feeding roller (not shown) mounted on a printer is pushed downward from above the cassette body 2 to be brought into contact with the upper surface of the uppermost paper. With a rotation of the roller, only the uppermost paper among the papers contained in the cassette body 2 is run onto the upper surfaces of a pair of separating sections 6 and 6, thereby separating the uppermost paper from the rest of the papers under the uppermost paper, and thereby feeding the uppermost paper into the printer. An arbitrary number of papers may be continuously fed by repeating the paper feeding process as described above.

Figure 3:
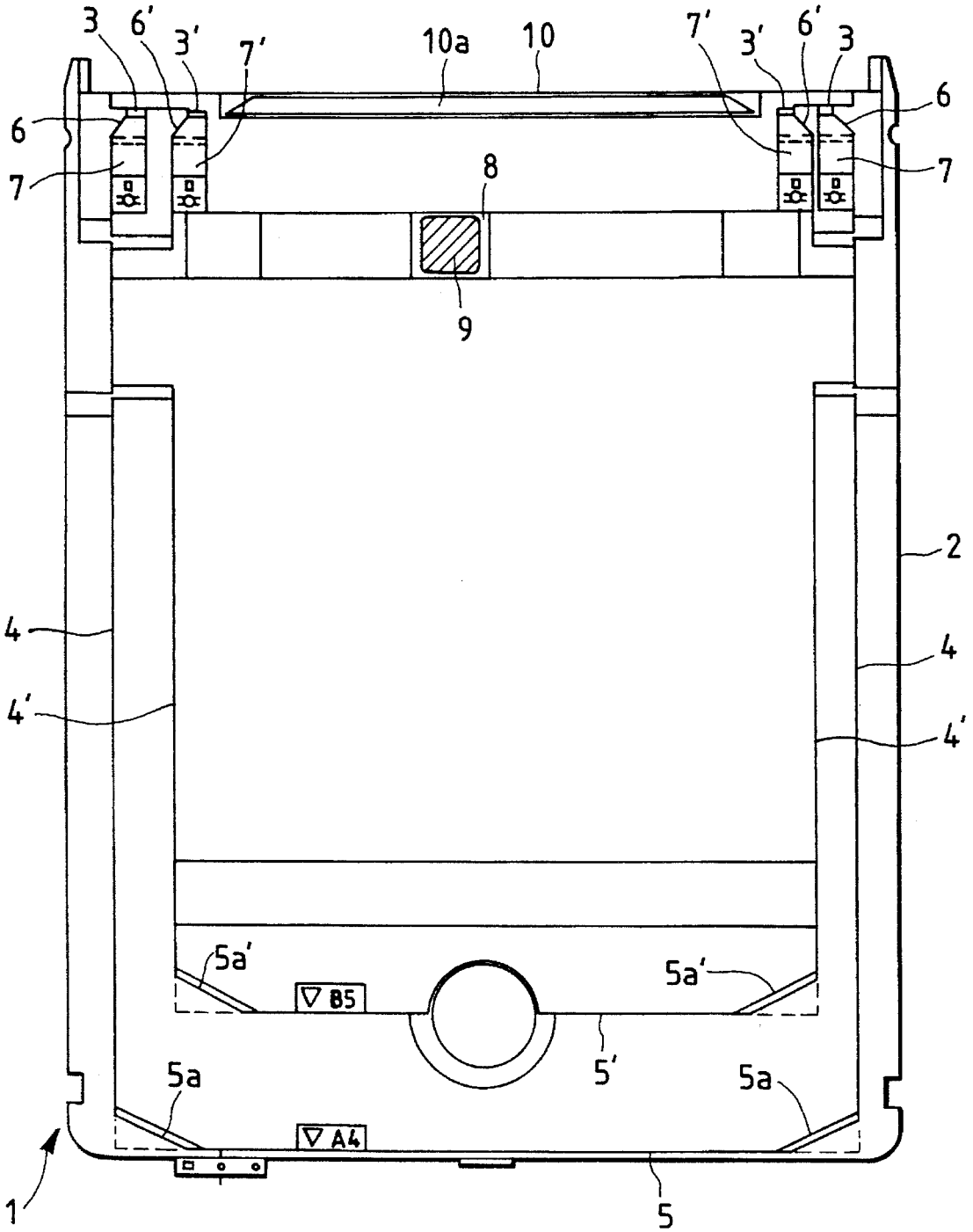
FIG. 3 is a plan view showing a paper feeding cassette according to a second embodiment of the present invention.

FIG. 3 shows a second embodiment of a paper feeding cassette according to the present invention. Referring to FIG. 3, the cassette body 2 is provided with a pair of inner front-edge guide sections 3' and 3', a pair of inner side-edge guide sections 4' and 4', an inner rear-edge guide section 5', a pair of inner separating sections 6' and 6', and a pair of inner elastic push-up members 7' and 7'. All of them are respectively located inside a pair of front-edge guide sections 3 and 3, a pair of side-edge guide sections 4 and 4, a rear-edge guide section 5, a pair of separating sections 6 and 6, and a pair of elastic push-up members 7 and 7 for containing and positioning A4-size papers described in the first embodiment of the present invention, and position B5-size papers (smaller than A4-size papers) at tier deeper positions than those of respective sections and members for positioning A4-size papers. At the bottom of the cassette body 2, a friction member 9 is provided in the same manner as that in the first embodiment as described above, and a paper guide section 10 is formed at the front-edge of the cassette 2. At both sides of the inner rear-edge guide section 5' guide grooves 5*a*' and 5*a*' are provided for guiding the upper surface of both side sections of the rear-edges of the B5-size papers when the both side sections of the rear-edges of the B5-size papers are inserted therein.

The paper feeding cassette of this embodiment functions as follows.

According to a paper feeding cassette of this embodiment, two types of different-sized papers, e.g. A4-size papers and B5-size papers can be contained, separated and fed.

When A4-size (larger size) papers are contained in the cassette body 2, a pair of front-edge guide sections 3 and 3, a pair of side-edge guide sections 4 and 4, and the rear-edge guide section 5 of the cassette body 2 position the front-edges, the side-edges, and the rear-edges of the A4-size papers. Both side sections of the front-edges of the papers are pushed upward toward the lower surfaces of a pair of separating sections 6 and 6 by the elasticity of a pair of push-up members 7 and 7 mounted on the cassette body 2, thereby bringing the upper surface of the uppermost paper into contact with the lower surfaces of a pair of separating sections 6.

Figure 7:
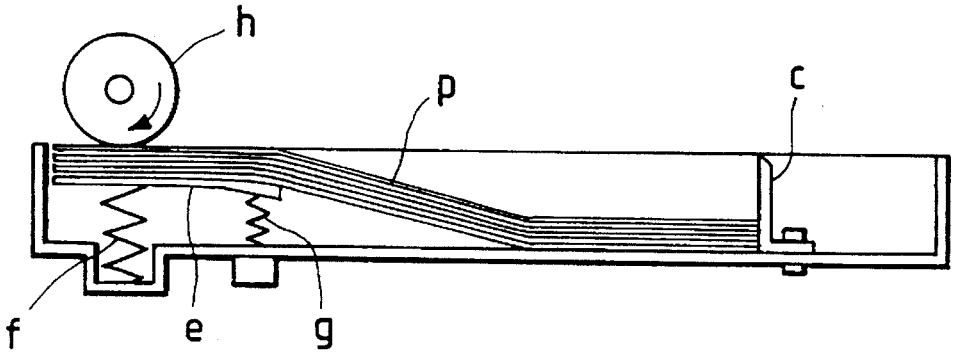
FIG. 7 PRIOR ART
FIG. 7 is a longitudinal sectional view showing construction of the conventional paper feeding cassette.

In this state, a paper feeding roller (see FIG. 7) mounted on the printer is pushed downward from above the cassette body 2 to be brought into contact with the upper surface of the uppermost paper. With a rotation of the roller, only the uppermost paper among the papers contained in the cassette body 2 is run onto the upper surfaces of a pair of separating sections 6 and 6, thereby separating the uppermost paper from the rest of the papers under the uppermost paper, and thereby feeding the uppermost paper into the printer.

When B5-size (smaller size) papers are contained in the cassette body 2, a pair of inner front-edge guide sections 3' and 3', a pair of inner side-edge guide sections 4' and 4', and the inner rear-edge guide section 5' of the cassette body 2 position the front-edges, the side-edges and the rear-edges of the B5-size papers. The both side sections of the front-edges of the papers are pushed upward toward the lower surfaces of a pair of inner separating sections 6' and 6' by the elasticity of a pair of inner push-up members 7' and 7' mounted on the cassette body 2, thereby bringing the upper surface of the uppermost paper into contact with the lower surfaces of a pair of inner separating sections 6' and 6'.

In this state, a paper feeding roller (see FIG. 7) mounted on the printer is pushed downward from above the cassette body 2 to be brought into contact with the upper surface of the uppermost paper. With a rotation of the roller, only the uppermost paper among the papers contained in the cassette body 2 is run onto the upper surfaces of a pair of separating sections 6' and 6', thereby separating the uppermost paper from the rest of the paperb 55038723.001 s under the uppermost paper, and thereby feeding the uppermost paper into the printer.

As has been described above, according to the paper feeding cassette of the second embodiment of the present invention, two types of different-sized papers may be used in a single cassette.

Although A4-size papers and B5-size papers are illustrated in this embodiment as the papers to be contained in the cassette body 2, this should not be construed restrictively. For example, as the size of the papers to be contained in the cassette body, various combinations such as A3-size and B4-size, A5-size and B6-size, A4-size and A5-size, and letter size and legal size or the like may be possible.

Figure 4:
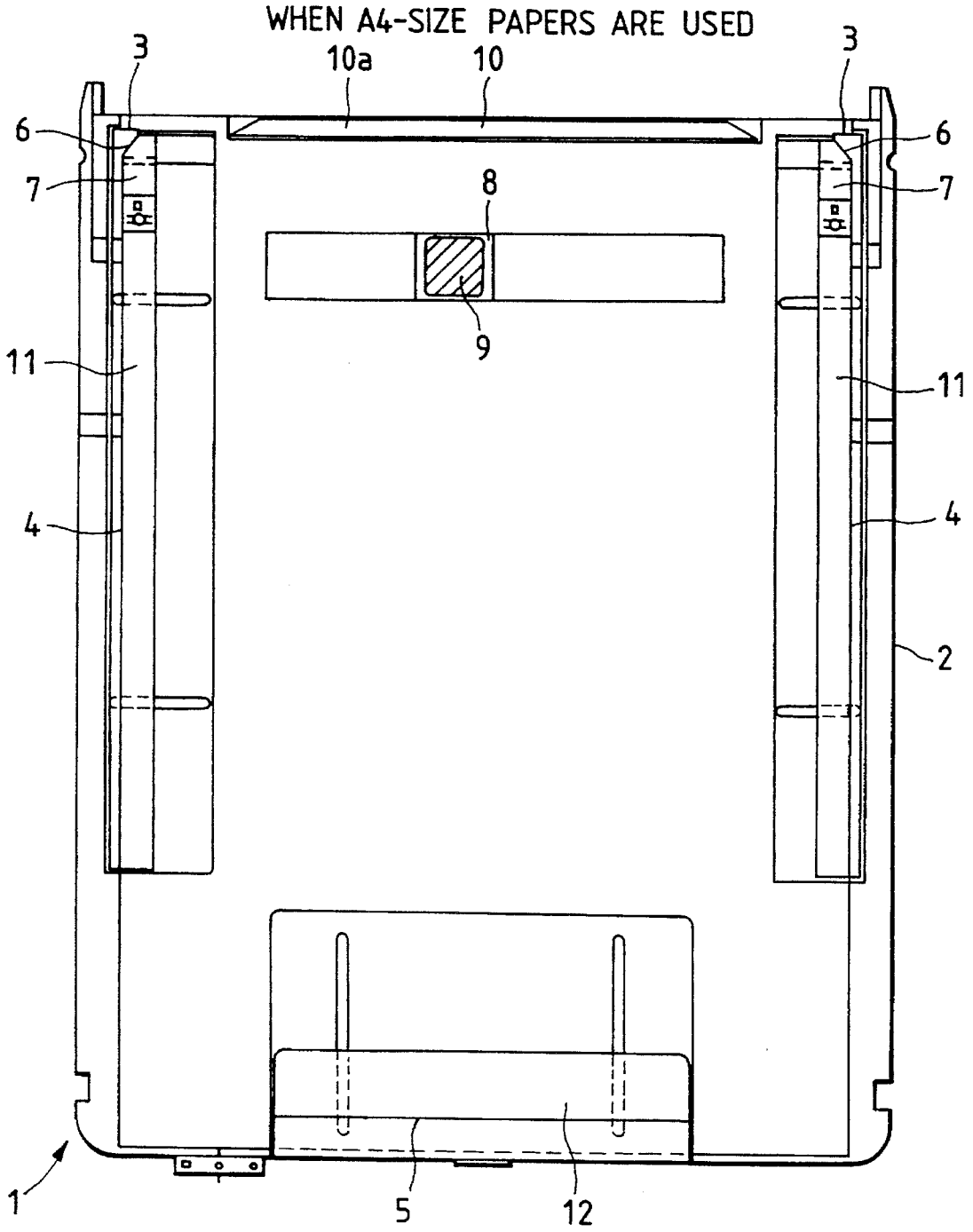
FIG. 4 is a plan view showing a paper feeding cassette according to a third embodiment of the present invention in which the paper feeding cassette is set to contain A4-size papers.
Figure 5:
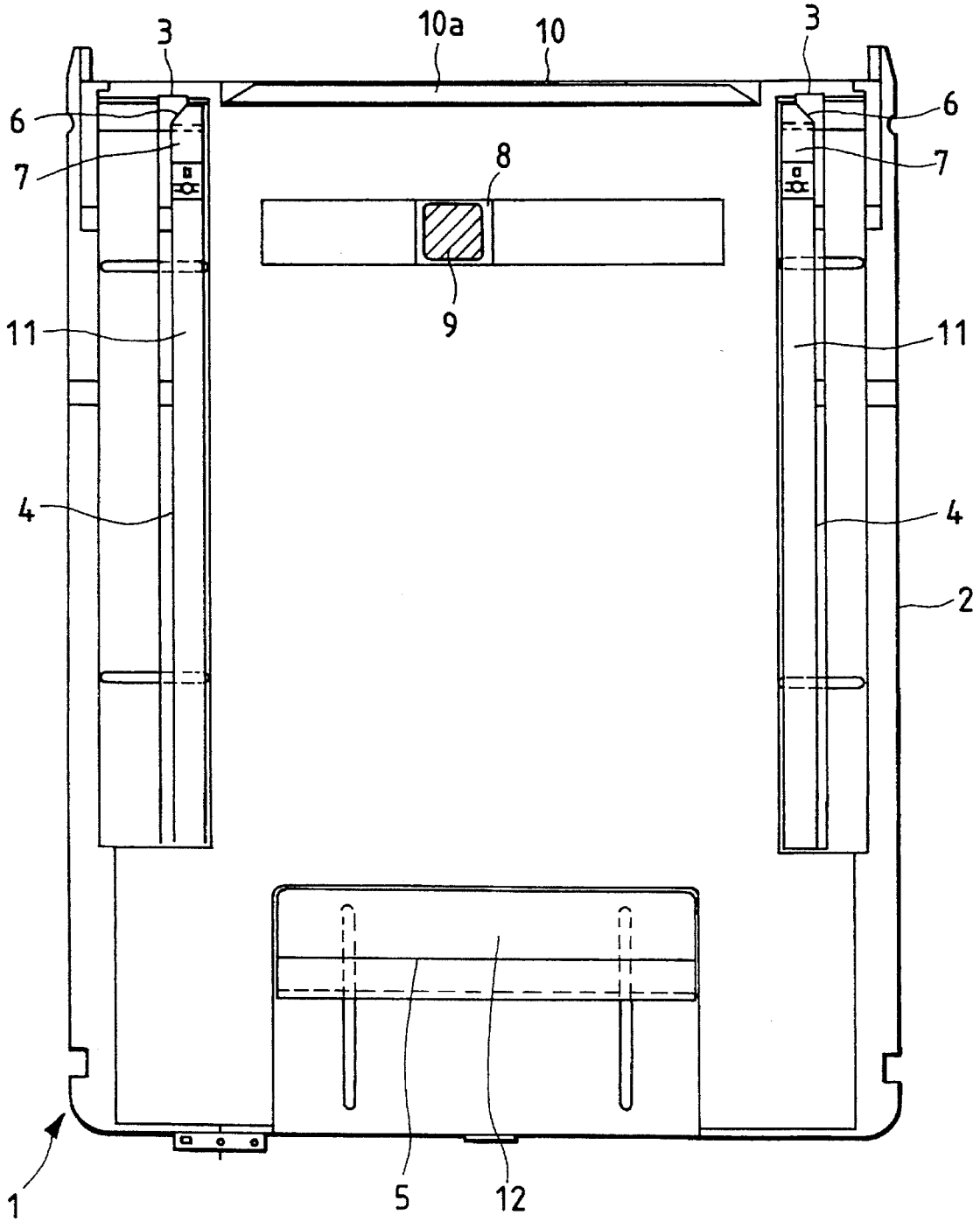
FIG. 5 is a plan view showing a paper feeding cassette according to a third embodiment of the present invention in which the paper feeding cassette is set to contain B5-size papers.
Figure 6:
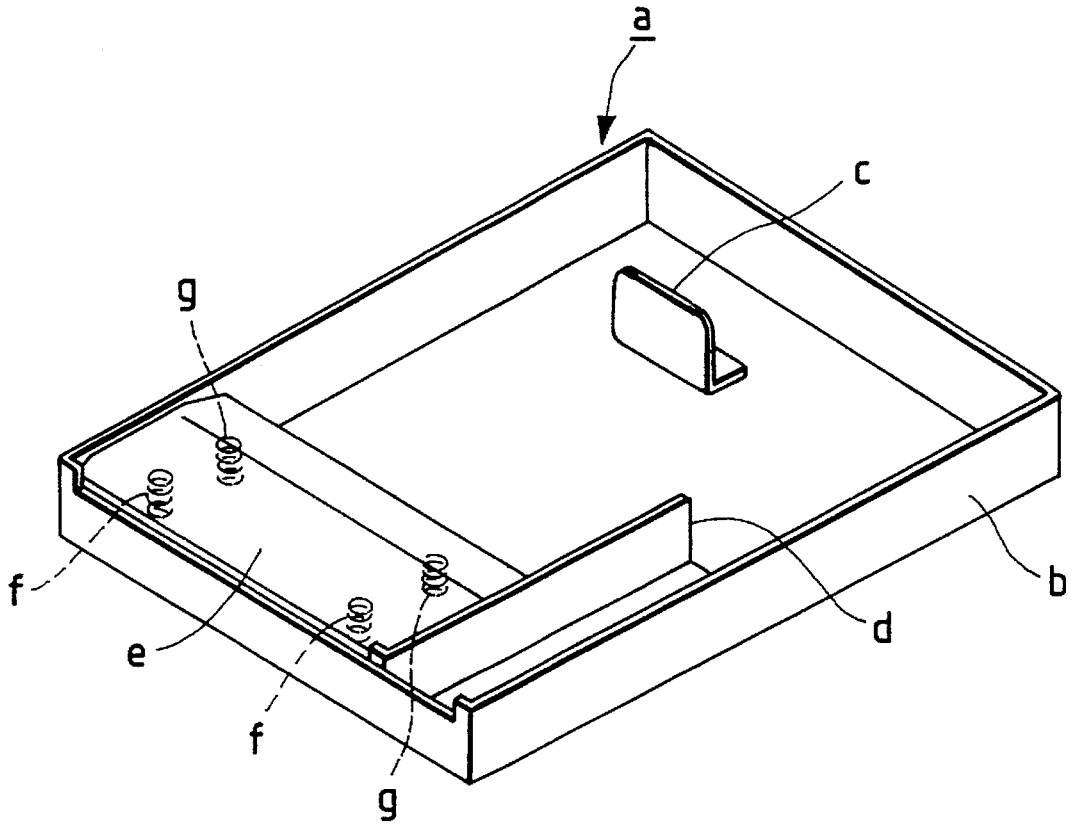
FIG. 6 PRIOR ART
FIG. 6 is a perspective view showing construction of the conventional paper feeding cassette.

FIGS. 4 and 5 show a third embodiment of a paper feeding cassette according to the present invention. FIG. 4 is a plan view showing a condition where A4-size papers are set in the paper feeding cassette of the present invention, and FIG. 5 is a plan view showing a condition where B5-size papers are set in the paper feeding cassette of the present invention.

Referring to FIGS. 4 and 5, the cassette body 2 is provided with a pair of side-edge guide members 11 and 11 movable in the width direction of the papers for positioning the side-edges of the papers in accordance with the width of the papers to be contained, and a rear-edge guide member 12 movable backward and forward for positioning the rear-edges of the papers in accordance with the length of the papers.

Each of the side-edge guide members 11 is provided with the front-edge guide section 3 for positioning the front-edges of the papers, the side-edge guide section 4 for positioning side-edges of the width direction of the papers, the separating section 6 for separating the papers contained in the cassette body 2 one at a time, and the push-up member 7 for pushing upward both side sections of the front-edges of the papers to be contained in the cassette body 2. At the bottom of the cassette body 2, a friction member 9 is provided in the same manner as that in the first embodiment as described above, and a paper guide section 10 is provided at the front-edge of the cassette body 2.

The paper feeding cassette of this embodiment functions as follows.

A pair of front-edge guide sections 3 and 3, and a pair of side-edge guide sections 4 and 4 provided on a pair of side-edge guide members 11 and 11 move in accordance with the width of the papers contained in the cassette body 2 in the width direction to position both side sections of the front-edges and side-edges of the papers, respectively, and the rear-edge guide member 12 moves backward and forward to position the rear-edges of the papers. Accordingly, the papers are arbitrarily positioned in accordance with the size thereof contained in the cassette body 2. And, both side sections of the front-edges of the papers are pushed upward toward the lower surfaces of a pair of separating sections 6 and 6 by a pair of push-up members 7 and 7 mounted on a pair of side-edge guide members 11 and 11, thereby bringing the upper surface of the uppermost paper into contact with the lower surfaces of a pair of separating sections 6 and 6.

As has been described above, according to the paper feeding cassette of the third embodiment of the present invention, any size of the papers, whether they are of definite form or indefinite form, may be contained, separated and fed.

Although a pair of movable side-edge guide members are illustrated in the embodiment as described above, it is also possible for one of the guide members to be a stationary guide member and for the other guide member to be a movable guide member.

Each of the embodiments as described above has been described as equipped with a plate spring-like push-up member. However, the construction of the push-up member is not limited to the above-described one, and various modifications are naturally possible as long as the paper can be resiliently pushed up. For example, it is possible to adopt a structure made of a elastic material or a structure which exhibits elasticity depending upon its construction.

In the paper feeding cassette according to the present invention, the thickness of the cassette can be substantially reduced, and the structure of the cassette can be simplified by reducing a parts count, whereby it is possible to achieve a reduction in the size and cost of the paper feeding cassette while efficiently maintaining its function of separating and feeding a plurality of papers contained therein one at a time.

What is claimed is:

1. A paper feeding cassette for use with an image reproduction apparatus, the image reproduction apparatus including a paper sheet removal mechanism for separating an uppermost paper sheet from a plurality of stacked paper sheets, each paper sheet of the plurality of paper sheets having opposing first and second front corners, paper feeding cassette comprising:

a sheet storing portion for storing the plurality of paper sheets, the sheet storing portion including a front edge;

first and second separating sections mounted on the sheet storing portion adjacent the front edge; and first and second resilient members mounted on the sheet storing portion adjacent the front edge, the first and second resilient members being located below the first and second separating sections, respectively;

wherein a distance between the first and second resilient members corresponds to a standard paper sheet size such that when the plurality of papers sheets having the standard paper size is stored in the sheet storing portion, the first and second resilient members directly contact, respectively, the first and second front corners of a lowermost paper sheet of the plurality of paper sheets and bias the plurality of paper sheets toward the first and second separating sections such that the first and second front corners of the uppermost paper sheet respectively contact the first and second separating sections.

2. The paper feeding cassette according to claim 1, wherein each of the first and second resilient members comprise a leaf spring having a fixed end fixedly connected to the sheet storing portion, and a free end extending from the fixed end toward the front edge of the sheet storing portion.

3. The paper feeding cassette according to claim 1, further comprising:

third and fourth separating sections mounted on the sheet storing portion adjacent the front edge, the third and fourth separating sections being located between the first and second separating sections; and third and fourth resilient members mounted on the sheet storing portion adjacent the front edge, the third and fourth resilient members being located between the first and second resilient members and respectively below the third and fourth separating sections;

wherein a distance between the third and fourth resilient members corresponds with a width of a second standard paper sheet size.

4. The paper feeding cassette according to claim 1, further comprising first and second side-edge guide members adjustably mounted to the sheet storing portion and adjustable in a direction which is parallel to the front edge;

wherein the first resilient member and first separating section are fixedly connected to the first side-edge guide member, and the second resilient member and second separating section are fixedly connected to the second side-edge guide member.

5. A paper feeding cassette for use with an image reproduction apparatus, the image reproduction apparatus including a paper sheet removal mechanism for separating an uppermost paper sheet from a plurality of stacked paper sheets, each paper sheet of the plurality of paper sheets having opposing first and second front corners, paper feeding cassette comprising:

a sheet storing portion for storing the plurality of paper sheets, the sheet storing portion including a front edge;

first and second side-edge guide members adjustably mounted to the sheet storing portion and adjustable in a direction which is parallel to the front edge;

first and second separating sections respectively fixedly connected to the first and second side-edge guide members and located adjacent the front edge; and first and second resilient members respectively fixedly connected to the first and second side-edge guide members and located adjacent the front edge, the first and second resilient members being located below the first and second separating sections, respectively;

wherein the first and second side-edge guide members are adjustable such that a distance between the first and second resilient members corresponds to one of a plurality of standard paper sheet sizes such that when the plurality of papers sheets having said one of the plurality of standard paper sizes is stored in the sheet storing portion, the first and second resilient members directly contact, respectively, the first and second front corners of a lowermost paper sheet of the plurality of paper sheets and bias the plurality of paper sheets toward the first and second separating sections such that the first and second front corners of the uppermost paper sheet respectively contact the first and second separating sections.

6. The paper feeding cassette according to claim 5, wherein the first and second resilient members comprise leaf springs, each leaf spring having a fixed end and a free end extending from the fixed end toward the front edge of the sheet storing portion.

7. A paper feeding cassette for use with an image reproduction apparatus, the image reproduction apparatus including a paper sheet removal mechanism for separating an uppermost paper sheet from a plurality of stacked paper sheets, each paper sheet of the plurality of paper sheets having opposing first and second front corners, paper feeding cassette comprising:

a sheet storing portion for storing the plurality of paper sheets, the sheet storing portion including a front edge;

first and second separating sections mounted on the sheet storing portion adjacent the front edge; and first and second resilient members, each of the first and second resilient members comprising a leaf spring having a fixed end and a free end extending from the fixed end toward the front edge of the sheet storing portion, the first and second resilient members being located below the first and second separating sections, respectively;

wherein when the plurality of paper sheets are stored in the sheet storing portion, the first and second resilient members directly contact, respectively, the first and second front corners of a lowermost paper sheet of the plurality of paper sheets and bias the plurality of paper sheets toward the first and second separating sections such that the first and second front corners of the uppermost paper sheet respectively contact the first and second separating sections.

* * * * *